United States Patent [19]

Mital

[11] Patent Number: 4,476,355

[45] Date of Patent: Oct. 9, 1984

[54] KEYBOARD ASSEMBLY

[75] Inventor: Dennis M. Mital, Western Springs, Ill.

[73] Assignee: Grayhill, Inc., LaGrange, Ill.

[21] Appl. No.: 548,500

[22] Filed: Nov. 3, 1983

Related U.S. Application Data

[63] Continuation-in-part of Ser. No. 319,388, Nov. 9, 1981, abandoned.

[51] Int. Cl.[3] ..... H01H 13/70; H01H 1/00

[52] U.S. Cl. ..... 200/5 A; 200/159 B; 200/275

[58] Field of Search ..... 200/5 A, DIG. 1, 159 B, 200/275, 292

[56] References Cited

U.S. PATENT DOCUMENTS

| | | | |
|---|---|---|---|
| 3,676,607 | 7/1972 | Nash et al. | 200/159 B X |
| 3,749,859 | 7/1973 | Webb et al. | 200/302 X |
| 3,806,673 | 4/1974 | Boulanger | 200/5 A |
| 4,071,718 | 1/1978 | Harden | 200/5 A |
| 4,074,088 | 2/1978 | Keough et al. | 200/5 A |
| 4,085,306 | 4/1978 | Dunlap | 200/275 |
| 4,096,364 | 6/1978 | Lynn et al. | 200/5 A |
| 4,194,105 | 3/1980 | Hodges | 200/275 X |
| 4,195,210 | 3/1980 | Pounds | 200/275 X |
| 4,207,448 | 6/1980 | Furusawa et al. | 200/159 B |
| 4,245,138 | 1/1981 | Harper | 200/5 A |
| 4,254,309 | 3/1981 | Johnson | 200/5 A |
| 4,263,485 | 4/1981 | Corwin | 200/302 X |
| 4,307,268 | 12/1981 | Harper | 200/5 A |
| 4,319,099 | 3/1982 | Asher | 200/5 A |

FOREIGN PATENT DOCUMENTS

| | | | |
|---|---|---|---|
| 2263321 | 7/1974 | Fed. Rep. of Germany | 200/159 B |
| 2432205 | 3/1980 | France | 200/275 |
| 260231 | 4/1970 | U.S.S.R. | 200/159 B |

*Primary Examiner*—J. R. Scott

*Attorney, Agent, or Firm*—Lee, Smith & Zickert

[57] ABSTRACT

A keyboard assembly including a printed circuit board having a plurality of dual channel switch sites thereon including a plurality of contacts defining keypads and dome-shaped conductive resilient elements generally called domes, coacting with the keypads which in their relaxed state maintain the switch open and in their depressed and tripped state close the switch. The domes are provided with a centrally disposed upwardly extending projection or dimple to be engaged by an actuator or button and a peripheral portion defining a contact surface for continually engaging one of the contacts on the switch site. The other contacts are engaged by a central portion of the dome when it is depressed and tripped. Each switch site includes a ring-shaped contact in continuous engagement with the peripheral portion of the dome and a pair of triangular or delta-shaped contacts disposed within the ring-shaped contact and engageable with the central portion of the dome when it is depressed and tripped. Alternately, the switch site may contain a single contact within the ring-shaped contact.

8 Claims, 11 Drawing Figures

KEYBOARD ASSEMBLY

This application is a continuation-in-part application of my application Ser. No. 319,388 filed Nov. 9, 1981 now abandoned.

This invention relates in general to a keyboard assembly, and more particularly to a keyboard assembly of the type which includes a printed circuit board and dome-shaped resilient elements coacting with switch sites on the printed circuit board, and still more particularly to an improved dome-shaped resilient element and an improved circuit pattern.

BACKGROUND OF THE INVENTION

Heretofore, it has been well known to have keyboard assemblies which includes switches on a printed circuit board consisting of dome-shaped resilient elements coacting with contacts at switch sites on the board where depression and tripping of a dome-shaped element causes actuation of the switch at the switch site of the element. While the switch is normally open, depressing of the dome-shaped resilient element and tripping of same causes the switch to close.

Typical dome-shaped resilient elements on a printed circuit board are illustrated in U.S. Pat. No. 3,967,084. Such elements have been called click springs, dome springs, snap dome switches, and quite often just domes. It is advantageous to use a dome because when depressed and actuated it produces a tactile feedback or snap action upon being tripped that is felt by the user to indicate switch closing action. These domes are in effect electrically conductive spring members which, when depressed and tripped and further depressed by a lesser force, will bridge contacts to close one or more electrical circuits. A spring return force is generated upon tripping which upon release of the depressing force causes the dome to return to its original form to open the contacts. The tactile feedback is considered the difference between the trip force and the release force.

Domes have been known to be of different shapes but usually are circular in form, such as disclosed in U.S. Pat. No. 3,967,084. An example of polygonally shaped domes is shown in U.S. Pat. No. 4,071,718. Further, domes have been formed with feet such as illustrated in U.S. Pat. No. 3,967,084.

Heretofore, the life of keyboard assemblies depends primarily upon the life of the domes. Failure of the domes has been encountered where they have been subjected to a number of tripping cycles. While the life expectancy heretofore may be extended in certain domes, it is done only at the sacrifice of tactile feel. Likewise, when better tactile feel is desired and built into a doom, life expectancy of the dome is sacrificed. Thus, heretofore it was possible only to obtain in domes either a desired life expectancy or a desired tactile feel. Another problem encountered with heretofore known domes is that they have been corner sensitive where, when an actuator button aligned with the dome is hit or pushed on its corner, it would not reliably make contact with all of the contacts.

SUMMARY OF THE INVENTION

Accordingly, it is one object of the present invention to provide a keyboard assembly having a new and improved dome-shaped resilient element for use with either single or double channel switch sites which is capable of incorporating both improved life expectancy and improved tactile feel and to also be less corner sensitive so that dome actuation and switch closure can be relied upon.

Another object of the present invention is to provide a new and improved dome having an outwardly extending centrally arranged projection for engagement by the button actuator to provide good button actuator to dome interface and good electrical contact in the tripped position, and to have a peripheral portion defining a contact surface for engagement with one of the contacts on a switch site.

A further object is in the provision of an improved dome having an outwardly extending dimple and a peripheral portion with a flat surface, a bottle cap surface, or a bottle cap and flat surface.

While the improved dome of the present invention can be used with a single sided printed circuit board switch where a conductive pattern is provided on only one side, it is especially useful for a double-sided printed circuit board where the outer contacts of the switch sites which are in continual engagement with the domes are provided with leads on the top surface to interconnect them in a circuit, and when the domes are tripped, the inner contacts on the switch sites that are engageable with the domes are connected by plated-through holes to circuit leads on the opposite side of the board. The advantage of a double-sided board over a single-sided board is that it is not necessary to coin a lead from the inner contacts at the edge of the dome to prevent contact with the dome.

Heretofore, with respect to double-sided boards, one form of contacts on switch sites having dual channels have been of a pie pattern which includes a plurality of pie-shaped circularly arranged segments with alternate segments being connected together to define the two channels and arranged within an outer ring contact. Such a switch is also considered to be a three circuit type as each of three contacts is connected to different circuits. This type of pattern provides a greater amount of contact area at the outer areas of the pattern and sometimes can cause malfunctioning in that the dome does not contact the pattern or a sufficient amount of the pattern to electrically connect the pattern with the dome.

Another form of dual channel switch site is the comb pattern which for the center contacts includes two sets of fingers or two combs where the fingers of one set are interpositioned with those of the other set. The finger contacts are disposed within a ring contact.

Accordingly, another feature of the invention is to provide an improved pattern for a dual channel switch site which will be engaged by the dome when it is depressed and tripped. This improved pattern includes a pair of triangularly shaped or delta-shaped contact segments in spaced and opposing relation to each other which provide a greater amount of contact surface near the area in which the center part of the domes will contact when they are depressed and tripped. Accordingly, more reliable contact action is obtained between the domes and the contacts of the switch site.

It is another object of this invention to provide a keyboard asseembly having a printed circuit board with dual channel switch sites on which domes arranged for contact therewith and which includes a first contact in continual engagement with the dome and second contacts of double-delta pattern that provides more reliable contact action with the dome when it is depressed and tripped.

It is a still further object of this invention to provide a keyboard assembly having a printed circuit board with dual channel switch sites where the central contact is of a double-delta pattern and where domes for the switch sites are structured to coact with the pattern such that dome and switch site life is materially increased and improved tactile feel is produced together with the dome being less corner sensitive when actuated.

Other objects, features and advantages of the invention will be apparent from the following detailed disclosure, taken in conjunction with the accompanying sheets of drawings, wherein like reference numerals refer to like parts.

DESCRIPTION OF THE PREFERRED EMBODIMENTS

Figure 1:
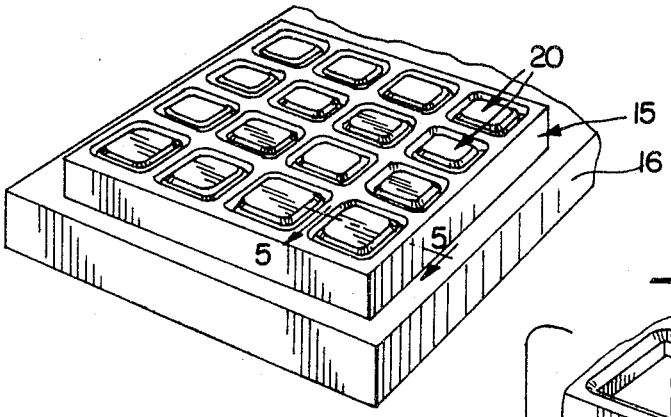
FIG. 1 is a perspective view of a keyboard assembly embodying the present invention.
Figure 2:
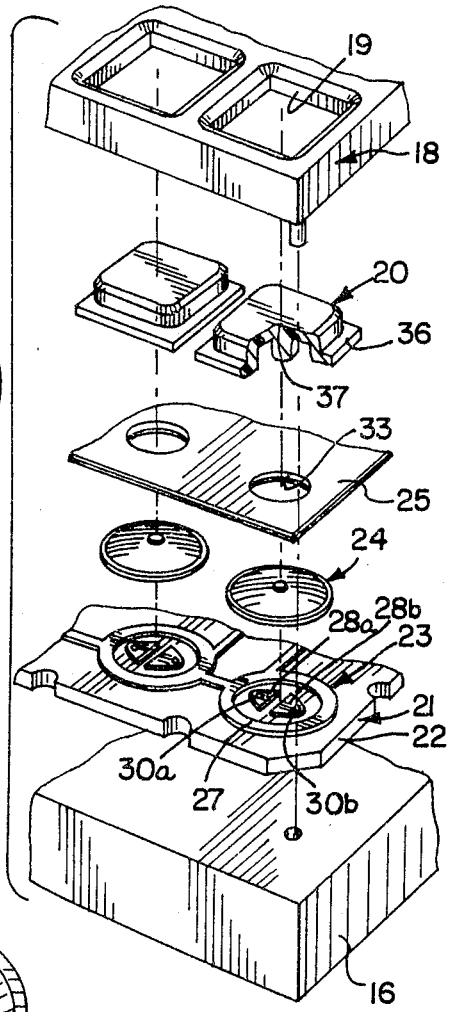
FIG. 2 is a fragmentary exploded view of the keyboard assembly of FIG. 1.

Referring now to the drawings and particularly to FIGS. 1 and 2, a keyboard assembly of the present invention and generally designated by the number 15 is illustrated in mounted relation on a panel 16. The keyboard assembly 15 is especially useful in calculators, computers, telephone equipment, or wherever there is a need for a plurality of pushbutton switches for controlling a signaling operation for circuitry. The assembly illustrated is of the type having 16 keys or buttons, but it should be appreciated that the present invention could be used with a keyboard having any number of switches with keys or buttons.

Figure 5:
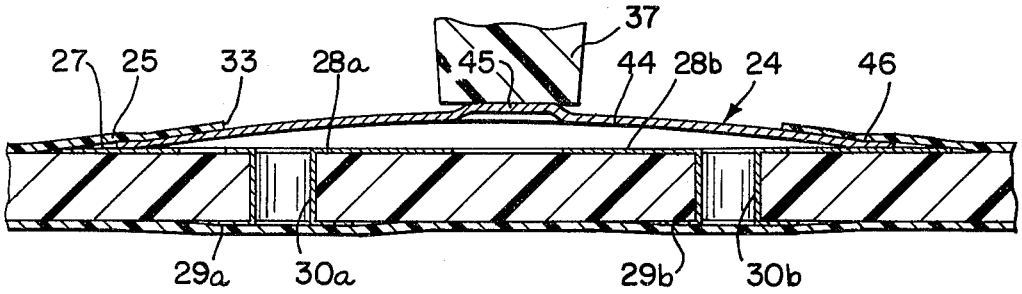
FIG. 5 is a greatly enlarged cross-sectional view taken through the center of one of the switches in the assembly, substantially along line 5—5 of FIG. 1, and illustrating the dome in relaxed position where the switch is open.
Figure 6:
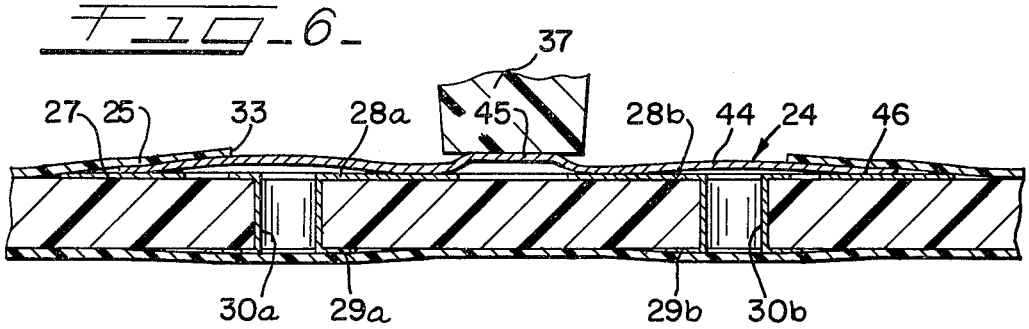
FIG. 6 is a view like FIG. 5, but illustrating the dome in collapsed or tripped condition for closing the switch.

Referring to FIG. 2, the keyboard assembly 15 comprises a frame or bezel 18 having a plurality of button or key openings 19, a plurality of buttons or keys 20 receivable in the openings 19, and a printed circuit board subassembly 21. The subassembly includes a printed circuit board having a substrate 22 supporting a plurality of conductive elements on both sides. A plurality of switch sites 23 are disposed on the top side which in turn include a plurality of contacts. The contacts of each switch site may be interconnected by leads with contacts of other switch sites, according to the design of the board. A plurality of domes or dome-shaped resilient elements 24 are held in place on the printed circuit board by a film 25 of electrical insulating material that is adhesively secured to the board. A single dome is in registry with and coacting with a single switch site to define a switch, as seen in FIGS. 5 and 6.

The substrate on which the switch sites 23 and leads are arranged is of suitable electrically insulating material. The switch sites 23 and leads may be formed on the substrate 22 in a conductive pattern or paths in any suitable manner such as by etched copper. Each switch site 23 includes a ring-shaped or circular contact 27 adapted to be engaged by the periphery of a dome 24 and double triangularly shaped contacts 28*a* and 28*b* arranged within the ring contact 27 and which are respectively connected to leads 29*a* and 29*b* formed on the underside of the substrate by means of plated-through holes 30*a* and 30*b*. The double triangularly shaped contacts may also be defined as a double-D or double-delta pattern and is unique and particularly adaptable for coacting with the improved dome of the present invention to provide better switching reliability.

It may now be appreciated that each switch site includes three contacts, each of which would normally be connected to a different circuit. Because of the two central delta-shaped contacts, each of which is connectable to a different circuit which would be connected to the ring contact upon depression of the dome, the switch is considered to have two channels. Any interconnection of contacts of adjacent switch sites will be made according to the design of the board.

The film 25 holding the domes in place may be of Mylar with a suitable adhesive layer on the underside. The film would cover over part or all of the domes and the printed circuit board. Preferably, the film 25 is provided with apertures 33 which align with the domes in the manner shown in FIGS. 3 and 8 so that the central area of the dome is completely exposed and in direct engagement with the button actuators 20, although the film may be aperture-free and cover the entire upper dome surfaces.

The buttons or key actuators 20 are formed to fit in the openings 19 and, while shown to be of square or rectangular configuration, could be of any other suitable configuration. The buttons include an upper portion 35 which is guidably and slidably received within the openings 19 and a flange or stop 36 that limits upward movement of the buttons and engages the bottom side of the frame when in the uppermost position. Further, the underside of each button includes a downwardly and centrally arranged projection or lug 37 that is in engaging contact with the central area of an aligned dome. The buttons are made of a suitable electrical insulating or non-conductive material as would be the frame 18. Where it would be desirable to shield the switches from electrostatic charges, the frame may be made conductive and connected to ground.

The improved domes 24 include a body 44 having an upwardly extending and centrally arranged dimple 45 which, as seen most clearly in FIGS. 2, 3, 5 and 6, presents a relatively flat surface against which the lug, projection or post 37 of the button actuator will engage. However, it should be recognized that the dimple surface may be spherical. Similarly, the surface of the projection 37 that engages the dimple 45 of the dome is substantially flat. The dimple structure programs the contact function of the dome to enhance electrical contact between the dome and board contacts, and enhances the interface with the button post.

Figure 3:
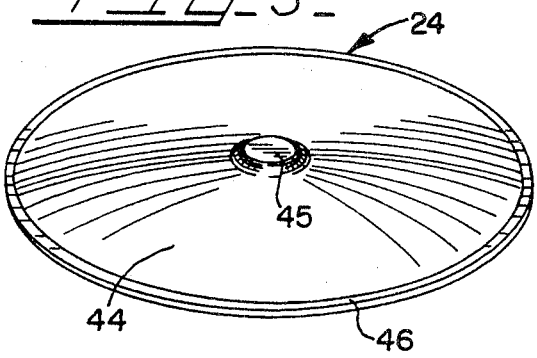
FIG. 3 is a top perspective view of the improved dome of the present invention.

The periphery of the dome body includes an annular flared portion 46 which, as seen more particularly in FIGS. 3 and 6, defines a substantially flat surface for engagement with the ring contact 28 of a switch site 22. The flared portion may also be termed a skirt for the dome, and it functions to program the collapsing action of the dome when it is depressed and tripped. Heretofore, domes such as in U.S. Pat. No. 3,967,084 have had partial skirts, and it has been determined that providing a full skirt as in the present invention increases the dome life. Further, the skirt or flared portion 46 together with the dimple 45 also improves the tactile feel of the dome. Moreover, the flat surface of the flared portion engaging the ring contact prevents damage to the outer ring contact because of the flat against flat sliding surface contact. Thus, the skirt defines a burr-free edge for the dome body to increase the life of the dome and also to protect the circuit board against damage during the cycling of the dome. The approximate dimensions of an exemplary dome made according to the invention in inches are: (a) outer diameter of 0.350, (b) dome curvature radius of 1.043, (c) dimple diameter of 0.055, (d) dimple height of 0.003, (e) skirt flatted portion of 0.005, and (f) dome material thickness of 0.003. The dome is preferably made of stainless steel and may be made of other electrically conductive and resilient materials. For larger and smaller domes, the dimensions would be generally proportional.

Figure 7:
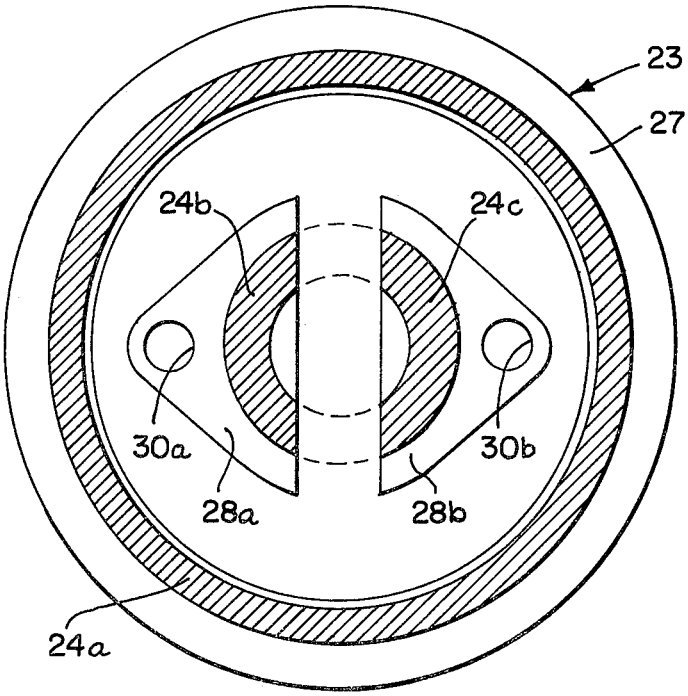
FIG. 7 is a plan view illustrating the keypad configuration of a switch site.

In operation of the switch the button actuator is depressed by applying a pressure at the dimple 45 of the dome, and when the trip force has been met, the dome is tripped which gives a snap action to the dome and causes the dome to collapse and take the shape substantially as illustrated in FIG. 6 wherein the center portion of the dome will engage both of the triangularly shaped pads of the contact 29, thereby closing the switch and establishing electrical communication between contacts 28 and 29. A single switch site 23 is illustrated in FIG. 7 which also illustrates the contact areas of a dome. The skirt 46 is in continuous contact with the ring-shaped contact 27, while the contacts **28*a* and 28*b* are in contact with the dome only when it is depressed. Dome contact area on contact 27 is indicated at 24*a*, while dome contact area on contacts 28*a* and 28*b* is indicated at 24*b* and 24*c*. The snap action is felt by the user, and when pressure is removed from the button actuator, the dome springs back to its original shape and also returns the button actuator to its original position, thereby opening the switch by breaking the electrical connection between the contacts. The dimple 45 and the flared skirt 46** coact to materially improve the life of the dome as well as the life of the switch site or circuit pattern on the printed circuit board. Additionally, the unique dome of the invention is less corner sensitive wherein if the button aligned with the dome is hit on the corner, it is unlikely that it will not actuate the dome as the button post will still engage the dimple.

While the dimpled dome 24 has been illustrated with the double-sided printed circuit board, it should be appreciated that it could be used with a single-sided printed circuit board provided the switch site is designed to accommodate the dome configuration.

Figure 8:
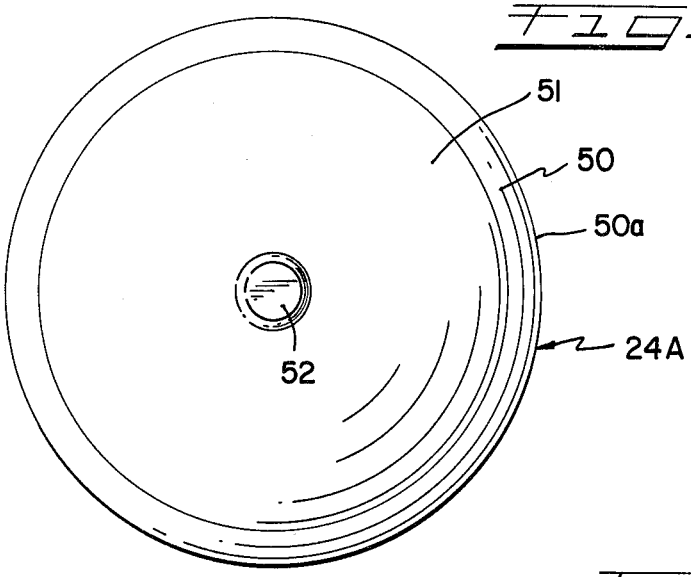
FIG. 8 is a plan view of a modified dome of the present invention having a bottle cap edge portion.
Figure 9:
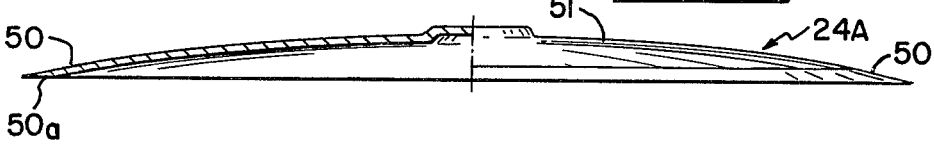
FIG. 9 is a partial sectional and elevational view of the dome in FIG. 8.

Referring now to the dome embodiment of FIGS. 8 and 9 which could be used in place of the dome embodiment above described, this embodiment, generally designated by the numeral 24A, is identical to the dome 24 except that the body of the dome terminates in an annular flared skirt 50 which extends downwardly toward the contact on the printed circuit board and forms an obtuse angle with the domed portion 51 of the dome. Skirt 50 is also of limited dimension and constant width as is the skirt 46 in dome 24. Skirt 50 terminates in a continuous edge **50*a* which engages the outer contact 27 on the circuit board. Since this dome also includes a central dimple 52 which is identical in form to the dimple 45 in dome 44. it likewise functions to provide good electrical contact with the contacts on the printed circuit board when the dome is tripped. Moreover, it provides good button post-to-dome interface, as does dome 24. This dome may be referred to as a bottle cap dome with an upwardly extending dimple inasmuch as the relationship of the flared skirt 50 to the dome portion of the body slightly resembles a bottle cap shape. The flared skirt 50** prevents the domes from inverting and further improves tactile feel.

Figure 4:
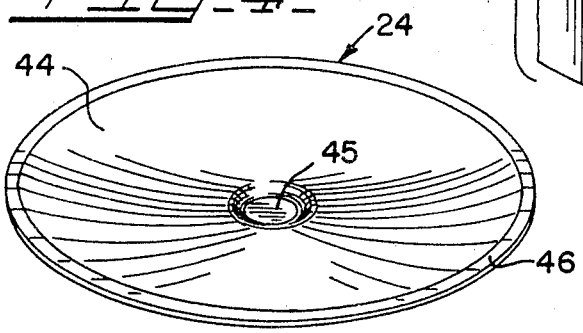
FIG. 4 is a bottom perspective view of the dome of FIG. 3.
Figure 10:
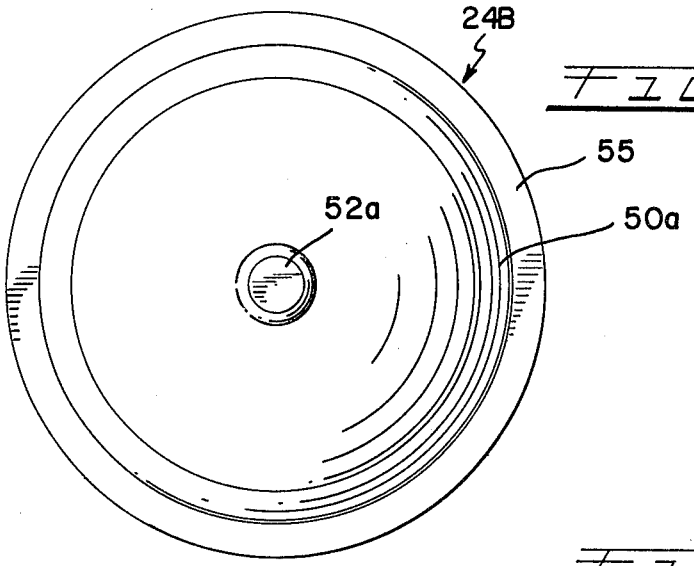
FIG. 10 is a plan view of another modified dome of the present invention having a bottle cap and flat surface edge portion.
Figure 11:
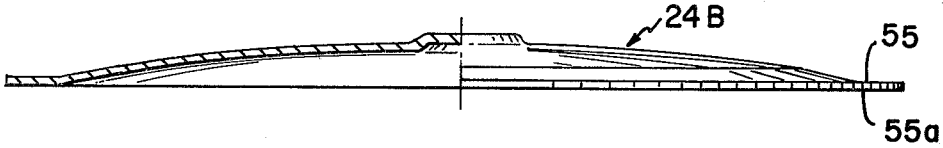
FIG. 11 is a partial sectional and elevational view of the dome in FIG. 10.

A further modified dome is shown in FIGS. 10 and 11 and is generally identified as 24B. Since this dome is similar to that in FIGS. 8 and 9 with the exception that it further includes an outermost annular flared skirt 55, the other portions are identified with the same numerals as used in FIGS. 8 and 9 except they have the suffix "a". The outer flared skirt 55 is of the same type as the flared skirt 46 of the dome 24 shown in FIGS. 3 and 4 to provide a flat surface **55*a* which engages the flat-surfaced outer contact 27 on the printed circuit board. Thus, dome 24B has the additional advantage over dome 24A of reducing wear on the board contact 27. Moreover, dome 24B** improves life by reducing strains on the outer edge which could be a starting point for cracks in the dome.

It will be understood that modifications and variations may be effected without departing from the scope of the novel concepts of the present invention, but it is understood that this application is to be limited only by the scope of the appended claims.

The invention is hereby claimed as follows:

1. In a keyboard assembly including a printed circuit board having conductive paths defining at least one switch site having spaced first and second flat-surfaced contacts connectable in a circuit, a conductive dome-shaped resilient element disposed on and coacting with the switch site, means retaining said element in aligned relation to said switch site, the periphery of said element continually engaging said first contact and the central area thereof contacting the second contact to electrically connect said contacts when the element is depressed and tripped, and a button actuator in registry with the element for depressing and tripping same, the improvement being in said dome-shaped element which comprises a dome-shaped body, a centrally disposed dimple projecting upwardly from the top side of said body for engagement with said button actuator, said dimple being formed to define a flat upper surface for engagement by said actuator, and a continuous annular flared skirt of limited dimension and constant width at the periphery of said body defining a substantially flat surface for slidable engagement with said flat-surfaced first contact, said body being dome-shaped between said dimple and said skirt, said dimple defining a circular contact area when the dome is tripped for engaging said second contact.

2. In a keyboard assembly including a printed circuit board having conductive paths on one side defining at least one switch site having a flat-surfaced outer ring-shaped contact and a pair of inner contacts each of which is connectable to a different circuit, said inner contacts being connected to leads on the other side of the board by plate-through holes. a conductive dome-shaped resilient element disposed on and coacting with the switch site, means retaining said element in aligned relation to said switch site, the periphery of said element continually engaging said flat-surfaced outer contact and the central area thereof contacting the inner contacts to electrically connect all of said contacts when the element is depressed and tripped, and a button actuator in registry with the element for depressing and tripping same, the improvement being in said dome-shaped element and said inner contacts, wherein said dome-shaped element includes a dome-shaped body, a centrally disposed dimple projecting upwardly from the top side of said body for engagement with said button actuator, said dimple being formed to define a flat upper surface for engagement by said actuator, and a continuous annular flared skirt of limited dimension and constant width at the periphery of said body defining a substantially flat surface for flat-to-flat sliding engagement with said flat-surfaced outer contact, said body being dome-shaped between said dimple and said skirt, said dimple defining a circular contact area when the dome is tripped for engaging said second contact, and said inner contact having a pair of triangularly shaped pads arranged so that the widest portions are engaged by the dome-shaped element when it is tripped.

3. The improvement defined by claim 2, wherein said pads are equilateral with the bases in opposed parallel relation and disposed on opposite sides of the center point of said outer contact.

4. The improvement defined in claim 2, wherein the bases of the pads are longer than the sides thereof.

5. In a keyboard assembly including a printed circuit board having conductive paths defining at least one switch site having spaced first and second flat-surfaced contacts connectable in a circuit, a conductive dome-shaped resilient element disposed on and coacting with the switch site, means retaining said element in aligned relation to said switch site, the periphery of said element continually engaging said first contact and the central area thereof contacting the second contact to electrically connect said contacts when the element is depressed and tripped, and a button actuator having a post extending therefrom in registry with the element for depressing and tripping same, the improvement being in said dome-shaped element which comprises a dome-shaped body, a centrally disposed dimple projecting upwardly from the top side of said body for engagement with said button actuator, said dimple being formed to project above the surface of the body for engagement by said actuator, and a continuous annular flared skirt of limited dimension and constant width at the periphery of said body defining a substantially flat surface extending downwardly toward said flat-surfaced first contact and terminating in a continuous edge for engagement with said first contact, said body being dome-shaped between said dimple and said skirt and forming on obtuse angle with said skirt, said dimple defining a circular contact area when the dome is tripped for engaging said second contact.

6. The dome-shaped element defined by claim 5, which further includes a second annular flared skirt of limited dimension and constant width extending from the periphery of said first mentioned annular flared skirt and defining a substantially flat surface for slidable engagement with said flat-surfaced first contact.

7. In a keyboard assembly including a printed circuit board having conductive paths defining at least one switch site having spaced first and second flat-surfaced contacts connectable in a circuit, a conductive dome-shaped resilient element disposed on and coacting with the switch site, means retaining said element in aligned relation to said switch site, the periphery of said element continually engaging said first contact and the central area thereof contacting the second contact to electrically connect said contacts when the element is depressed and tripped, and a button actuator having a post extending therefrom in registry with the element for depressing and tripping same, the improvement being in said dome-shaped element which comprises a body having a dome-shaped portion, an upwardly projecting dimple centrally disposed on said dome-shaped portion for engagement with said button actuator, said dimple being formed to define an upper surface for engagement by said actuator, a first annular substantially flat skirt of limited dimension and constant width extending downwardly from the periphery of said dome-shaped portion and forming an obtuse angle therewith, and a second annular substantially flat skirt of limited dimension and constant width extending horizontally from the periphery of said first skirt for slidable engagement with said flat-surfaced first contact, whereby said dimple defines a circular contact area when the dome is tripped into engagement with said second contact.

8. In a keyboard assembly including a printed circuit board having conductive paths defining at least one switch site having spaced first and second flat-surfaced contacts connectable in a circuit, a conductive dome-shaped resilient element disposed on and coacting with the switch site, means retaining said element in aligned relation to said switch site, the periphery of said element continually engaging said first contact and the central area thereof contacting the second contact to electrically connect said contacts when the element is depressed and tripped, and a button actuator in registry with the element for depressing and tripping same, the improvement being in said dome-shaped element which comprises a dome-shaped body, a centrally disposed dimple projecting upwardly from the top side of said body for engagement with said button actuator, said dimple being formed to define an upper surface for engagement by said actuator, and a continuous annular flared skirt of limited dimension and constant width at the periphery of said body defining a substantially flat surface for slidable engagement with said flat-surfaced first contact, said body being dome-shaped between said dimple and said skirt, said dimple defining a circular contact area when the dome is tripped for engaging said second contact.

* * * * *

UNITED STATES PATENT AND TRADEMARK OFFICE

CERTIFICATE OF CORRECTION

PATENT NO. : 4,476,355

DATED : October 9, 1984

INVENTOR(S) : Dennis M. Mital

It is certified that error appears in the above—identified patent and that said Letters Patent is hereby corrected as shown below:

Col. 2, line 57, change "center" to --central--;
line 63, after "domes" insert --are--;
Col. 6, line 10, change the period (.) to a comma (,);
Col. 7, line 4, change "plate-through" to --plated-through--;
change the period (.) to a comma (,).

Signed and Sealed this

*Fourth* Day of *June 1985*

[SEAL]

*Attest:*

DONALD J. QUIGG

*Attesting Officer* *Acting Commissioner of Patents and Trademarks*